US005678503A

United States Patent [19]

Poranski, Sr.

[11] Patent Number: 5,678,503

[45] Date of Patent: Oct. 21, 1997

[54] METHOD FOR MOORING FLOATING STORAGE VESSELS

[75] Inventor: Peter F. Poranski, Sr., Houston, Tex.

[73] Assignee: FMC Corporation, Chicago, Ill.

[21] Appl. No.: 599,859

[22] Filed: Feb. 13, 1996

Related U.S. Application Data

[63] Continuation of Ser. No. 339,924, Nov. 15, 1994, abandoned, which is a continuation of Ser. No. 162,496, Dec. 3, 1993, abandoned.

[51] Int. Cl.[6] ..... B63B 21/50

[52] U.S. Cl. ..... 114/230; 114/293

[58] Field of Search ..... 114/230, 293; 441/3–5

[56] References Cited

U.S. PATENT DOCUMENTS

| | | | |
|---|---|---|---|
| 2,986,888 | 6/1961 | Borrmann et al. | 114/293 |
| 3,703,151 | 11/1972 | Clement | 114/230 |
| 4,509,448 | 4/1985 | Pease et al. | 114/293 |
| 4,892,495 | 1/1990 | Svensen | 114/230 |
| 5,044,297 | 9/1991 | de Baan et al. | 114/293 |
| 5,159,891 | 11/1992 | Lohr et al. | 114/230 |

FOREIGN PATENT DOCUMENTS

| | | | |
|---|---|---|---|
| 8802980 | 1/1990 | Netherlands | 114/230 |
| 2250006 | 5/1992 | United Kingdom . | |

*Primary Examiner*—Edwin Swinehart
*Attorney, Agent, or Firm*—Bush, Riddle & Jackson, LLP

[57] ABSTRACT

A method of mooring a storage vessel in the sea is provided. A turret is mounted in a well forward of the vertical center-line of the vessel. A plurality of anchor legs are disposed between the sea bed and the turret. Each anchor leg is fixedly secured to the turret. A mooring buoy is fixedly secured at a submerged position in each anchor leg. The position and buoyancy of the buoy is selected so that normal anchor leg catenary forces which are largely vertical at the connection to a turret have enhanced horizontal components due to the buoyancy of the buoy holding up the anchor leg at a submerged position in the sea. Such enhanced horizontal components enable sufficient torque to be developed between the vessel and the turret so that the vessel may weathervane due to environmental forces such as wind and current. Accordingly, the vessel may be maintained on station and achieve a heading toward environmental forces without the need for auxiliary thrusters or separate turret drives.

8 Claims, 2 Drawing Sheets

METHOD FOR MOORING FLOATING STORAGE VESSELS

This application is a continuation of application Ser. No. 08/339,924 filed Nov. 15, 1994; which is a continuation of application Ser. No. 08/162,496 filed Dec. 3, 1993, both now abandoned.

BACKGROUND OF THE INVENTION

1. Field of the Invention

This invention relates to a method for mooring floating storage vessels, and more particularly to such a method for the permanent mooring of a floating storage vessel for withstanding storms and the like.

2. Description of Prior Art

Mooring systems for floating storage vessels are known in the mooring system art which have a turret provided in a vessel mounted in a well thereof and supported for rotation therein by bearings. Such turret systems can be classified generally as permanently moored systems, in which the turret is anchored via anchor legs to the sea floor or disconnectable moored systems in which the turret may be quickly detached from the anchor legs.

Disconnectable mooring systems find application in bodies of water in which fierce storms occur or in which ice floes are present. Certain disconnectable mooring systems provide a mooring element or buoy which is permanently placed at the offshore field but which may be connected and disconnected from the turret of a production vessel. Thus, in the event that dangerous weather conditions are imminent, the storage vessel may be disconnected from the mooring system and moved to a safe area to wait until the storm or ice floe passes. When the storm conditions pass, the storage vessel is returned to the offshore field and reconnected to the mooring system which has remained in position.

As shown in U.S. Pat. No. 4,604,961 issued Aug. 12, 1986, a well or moon pool is provided between the bow and stern of a vessel. A turret is rotatably mounted in the well at a position adjacent the bottom of the vessel. The mooring system is connected or disconnected from the turret. Once a mooring system is connected to the turret, the vessel is free to move about the turret. A plurality of mooring lines or legs are attached to the turret and extend to the ocean floor. The mooring lines or legs normally comprise chains and wire ropes or cables, and particularly in deep water are of a substantial weight which is exerted against the turret. The turret is mounted in bearings. Frictional forces exerted by the turret against the bearings can be substantial because of the weight of the anchor legs. The anchor lines, particularly when the vessel is anchored in deep water, such as over 200 meters in depth, exert a substantial vertical load on the turret. A number of anchor lines, such as 8 or 10 anchor lines, are spaced at arcuate intervals about the turret with each anchor line exerting a vertical lead on a turret.

Heretofore, such as illustrated in U.S. Pat. No. 4,509,448 dated Apr. 9, 1985, a mooring system has been proposed for turret moored drill ships in which a plurality of spaced mooring lines anchored to the sea floor are releasably connected at submersible buoys to the turret of a drill ship. The drill ship has a disconnect/connect system at the submersive buoys so that the drill ship may be rapidly disconnected from its mooring in the event of precarious weather, such as an approaching storm or the like, and moved out of the path of the approaching storm, ice floes, or the like. After the weather has subsided or passed on, the drill ship is returned to its mooring system and reconnected. However, the specific means and steps involved in connecting and disconnecting the vessel turret from the mooring legs is relatively cumbersome and complex.

SUMMARY OF THE INVENTION

The present invention is directed to a mooring system for a permanently moored floating storage vessel designed to withstand 100 year maximum storm conditions. The mooring system is of the kind to permit a floating storage vessel to remain on station during storms and other weather conditions without any disconnection from the mooring system.

The mooring system of the present invention includes a plurality of equally spaced anchor legs connected to a turret in a well of the moored vessel with a submerged buoy being provided for each anchor leg for supporting at least a substantial portion of the weight of the anchor leg in order to reduce vertical loads on the turret and its associated bearings. The system is designed to withstand 100 year environmental conditions including storm and ice conditions. The vessel characteristics, the components of the mooring system, and the environmental conditions are coordinated to withstand the forces of surge, sway, roll and yaw of the vessel. The maximum and minimum line loads are developed for each of the anchor legs.

Each of the anchor legs comprises a combination of chain and wire rope with a relatively large submerged support buoy. The submerged support buoy is at least about 20 metric tons and may be submerged at a depth between about 35 and 150 meters depending on such factors as the size of the vessel, the number of anchor lines, and the depth of the water. Risers or riser lines from the sea floor to the turret are provided as a conduit for oil and gas products from hydrocarbon production wells to the vessel. The anchor legs are angularly spaced about said turret and arranged in an umbrella-like fashion from the turret over the risers. The anchor legs with submerged support buoys are provided so that there is no contact between the risers and the anchor legs at any time even under the most adverse conditions for 100 year environmental or storm conditions.

The present mooring system utilizing submerged buoys for supporting anchor legs has many advantages over a conventional turret mooring system:

(1) A large area is provided for risers so that no interference or contact between the risers and anchor legs is obtained under any conditions of use.

(2) The turret mooring force deflection characteristics are linear over the displacement range of the moored vessel. Thus, large system forces are not generated from small displacement offsets of the vessel.

(3) The total system vertical loads on the turret are small thereby to simplify the design and reduce the cost of the mooring system.

(4) The submerged support buoys improve the geometry of the anchor legs to provide a sufficient torque from the relatively large horizontal force component in the anchor lines so that a separate turret drive system is not required for rotative movement of the turret.

(5) The wave frequency loads on the anchor legs are low to minimize fatigue of the anchor legs and mooring system.

(6) The support buoys are advantageous during initial installation of the anchor legs for the mooring system.

(7) As a result of the force-deflection characteristics that are inherent in the resulting arrangement, installation tolerances for anchor/anchor pile placement may be increased without adversely affecting mooring system performance.

As indicated above, the axial line force curve and the net restoring force curve for the anchor legs of the present invention are substantially linear for displacement of the vessel thereby minimizing any peak loads in the anchor legs and the turret. Non-linear force curves provide relatively large force variations in the anchor legs for relatively small offsets or displacements of the vessel and are therefore undesirable.

Each anchor leg extends from the turret to the submerged buoy, and from the submerged buoy to the sea floor. The weight of each anchor leg below the associated submerged buoy is not transferred to the turret. Only about 50 percent of the weight of the anchor legs supported between the submerged buoy and the turret is transferred to the turret. Thus, a minimal weight of the anchor leg is transmitted to the turret. Furthermore, the horizontal component of the weight of an anchor leg between the submerged buoy and the turret is proportionally greater relative to the vertical component as compared with a conventionally moored vessel in which submerged buoys are not connected in the anchor legs. The horizontal force component applied against the turret provides a relatively large torque that permits rotation of the turret without separate turret drive means.

It is an object of this invention to provide a mooring system for a floating storage vessel which is designed to remain on station during storms and other environmental conditions.

It is a further object of this invention to provide such a mooring system in which an anchor leg extending from a turret in the storage vessel is supported from a submerged support buoy for minimizing vertical loads on the turret from the anchor leg.

An additional object of this invention is to provide for an oil or gas storage vessel having a plurality of risers extending to the sea floor, a plurality of anchor legs spaced about the vessel and supported by submerged support buoys outwardly from the vessel in an umbrella-like effect over the risen in order to prevent any contact between the anchor legs and the risers even under the most adverse environmental conditions so as to permit the vessel to remain on station at all times.

Other objects, features and advantages of this invention will become more apparent from the following specification and drawings.

DESCRIPTION OF THE INVENTION

Figure 1:
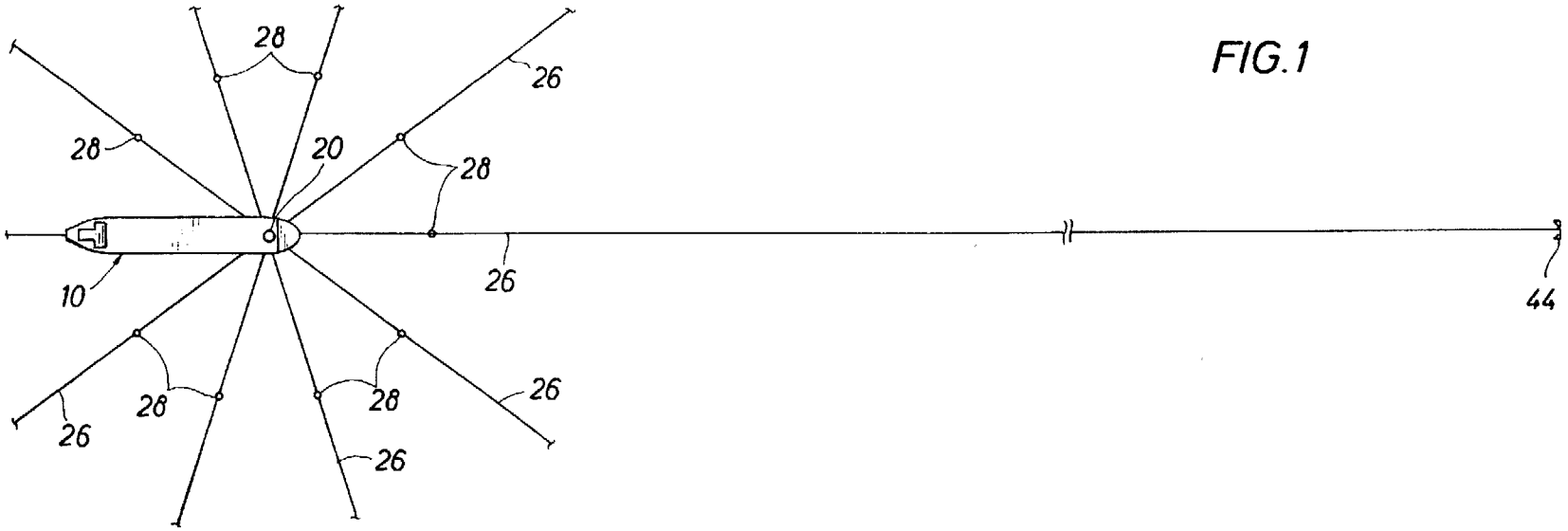
FIG. 1 is a schematic plan view of an oil or gas storage vessel moored with a plurality of anchor legs to the sea floor in accordance with the present invention.
Figure 2:
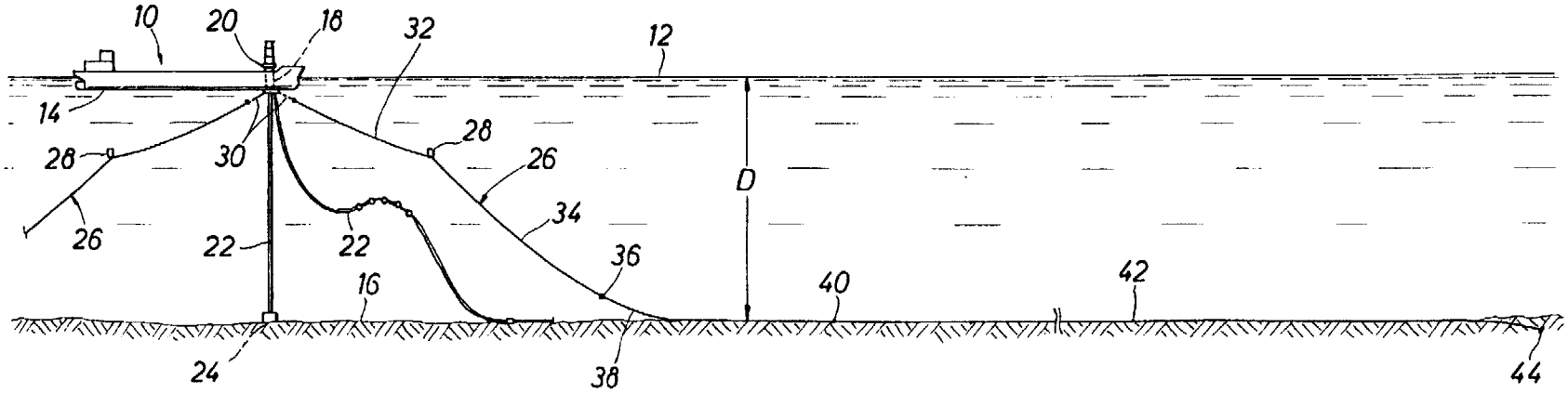
FIG. 2 is a schematic elevational view of the vessel in FIG. 1 showing an anchor leg secured to the vessel and extending to an anchor in the sea bed.

Referring to the drawings, a vessel 10 for the storage of oil or gas is shown as floating on the surface or sea level 12 of a body of water, such as a sea or ocean. Vessel 10 has a keel 14 positioned below the sea surface 12. The sea bed or sea floor is shown at 16. Vessel 10 has a moon pool or well at 18 centrally of the width of vessel 10. A turret, generally indicated at 20, is mounted within well 18 for rotation about a vertical axis as will be explained further below.

Flexible risers 22 extend from turret 20 downwardly to sea floor 16 and are connected to production wells such as illustrated at 24 for the transport of oil or gas to storage vessel 10 for temporary storage. Risers 22 have a sufficient flexible length to permit a predetermined movement of vessel 10 without any damage to risers 22.

A plurality of anchor legs indicated generally at 26 are spaced about turret 20 (at arcuate intervals of thirty-six (36) degrees in a preferred embodiment as shown particularly in FIG. 1. Each anchor leg 26 is generally identical and includes a plurality of connected chains and wire ropes. Connected intermediate the length of each anchor leg 26 is a submerged support buoy generally indicated at 28 which forms an important part of this invention. Submerged support buoy 28 is of a relatively large size, at least around 20 metric tons in displacement, and may be around 50 metric tons in displacement. A support buoy 28 of about 35 metric tons is adequate for most applications. The weight of the chains and wire ropes forming the catenary between support buoy 28 and vessel 10, and the weight of the wire ropes and chains between buoy 28 and sea floor 16, cause support buoy 28 to be submerged. The depth of support buoy 28 is determined by the equilibrium point where the upward force from the buoyancy of buoy 28 balances the downward force from the chains and wire ropes. An equilibrium depth of buoy 28 may, for example, be around 75 meters and generally is at a submerged depth range between about 35 and 150 meters.

The depth of support buoy 28 is also designed so that any contact between anchor legs 26 and risers 22 is prevented even upon the most adverse storms or other environmental conditions expected to be encountered by vessel 10 while remaining on station. As support buoy 28 sinks in the water, the loading on such buoy 28 decreases as a result of an increased amount of the anchor leg laying on sea floor 16.

The downward weight of the chains and wire ropes for anchor leg 26 and the desired depth of submerged buoy 28 generally determines the size of buoy 28. However other factors include the size and type of vessel, the number of anchor legs, and the environmental conditions for a 25, 50, 75 or 100 year design period. The environmental conditions include current, wave and wind conditions, water depth, and possible ice conditions. Ballast may be added to buoy 28 to provide the precise buoyancy required to yield the desired equilibrium depth. The equilibrium depth of buoy 28 will also vary dependent on whether the associated anchor leg is the most loaded anchor leg or the least loaded anchor leg as determined by the pull from vessel 10. The difference in depths of submerged support buoys 28 of the most loaded anchor leg and the least loaded anchor leg may vary from 20 to 25 meters, for example, depending primarily on the length of the anchor leg.

Each anchor leg 26 includes a short length of chain 30 connected to turret 20, and a wire rope 32 connected between chain 30 and submerged support buoy 28 to form a catenary between vessel 10 and buoy 28. A wire rope 34 extends from buoy 28 downwardly toward the sea floor 16. It is connected at 36 above sea floor 16 to a chain 38 which runs along the surface of sea floor 16. Chain 38 is connected at 40 to wire rope 42 which extends along sea bed 16 to an anchor 44 embedded in the sea bed. As a specific example of design parameters of an anchor leg for one proposed system, a 140,000 dwt vessel is shown having ten (10) anchor legs 26 as shown in FIG. 1, where chain 30 is about 5 meters in length, wire rope 32 is about 200 meters in length, wire rope 34 is about 275 meters in length, chain 38 is about 325 meters in length, and wire rope 42 is about 1,000 meters in length. Thus, the length of the anchor leg line between turret 20 and support buoy 28 formed by chain 30 and wire rope 32 is around 205 meters in length in order to space buoy 28 adequately from riser lines 22 and to provide the desired catenary between turret 20 and buoy 28.

Figure 4:
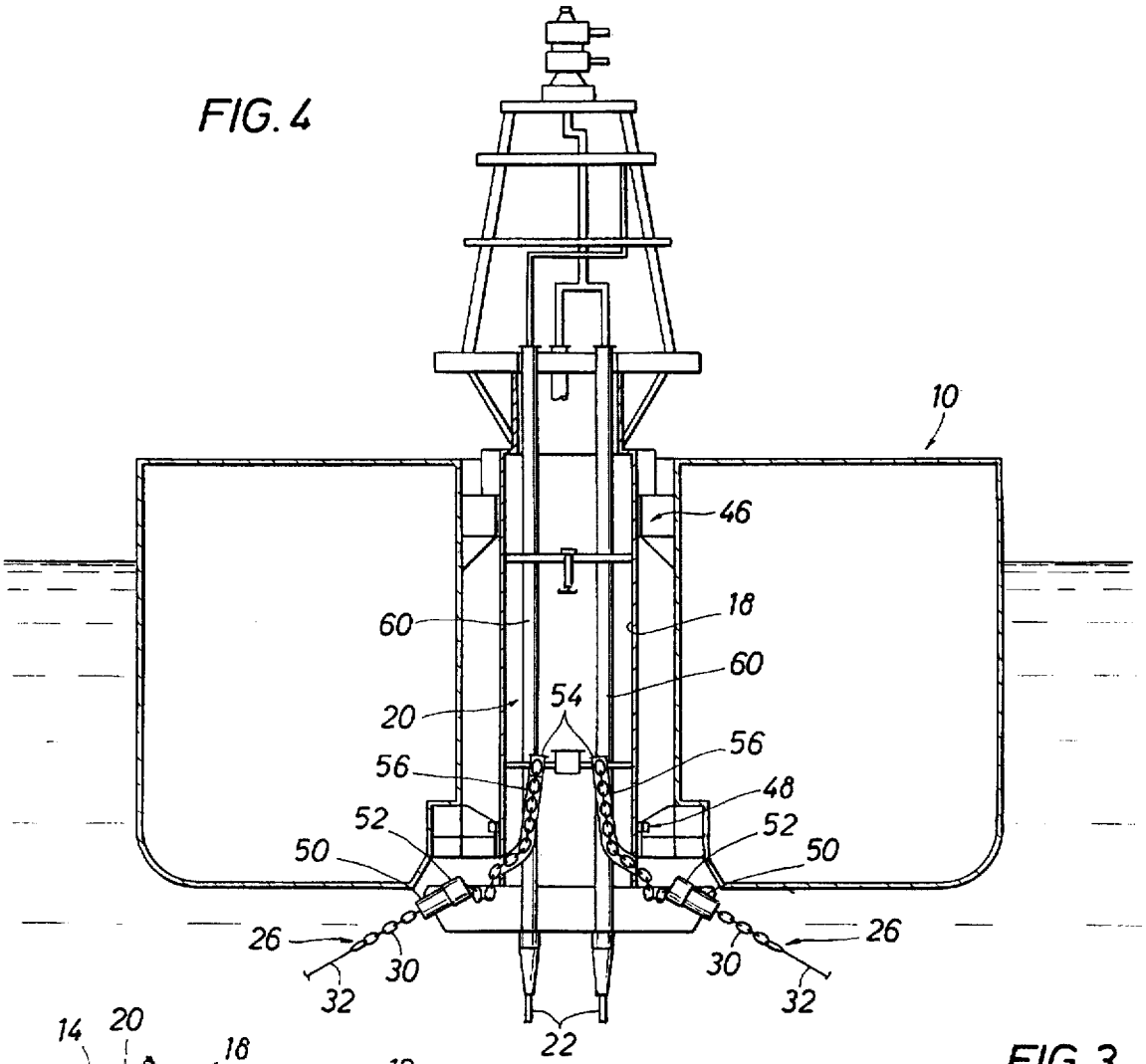
FIG. 4 is a sectional view of a turret for the storage vessel having risers extending downwardly therefrom and showing anchor legs connected to the turret.
Figure 3:
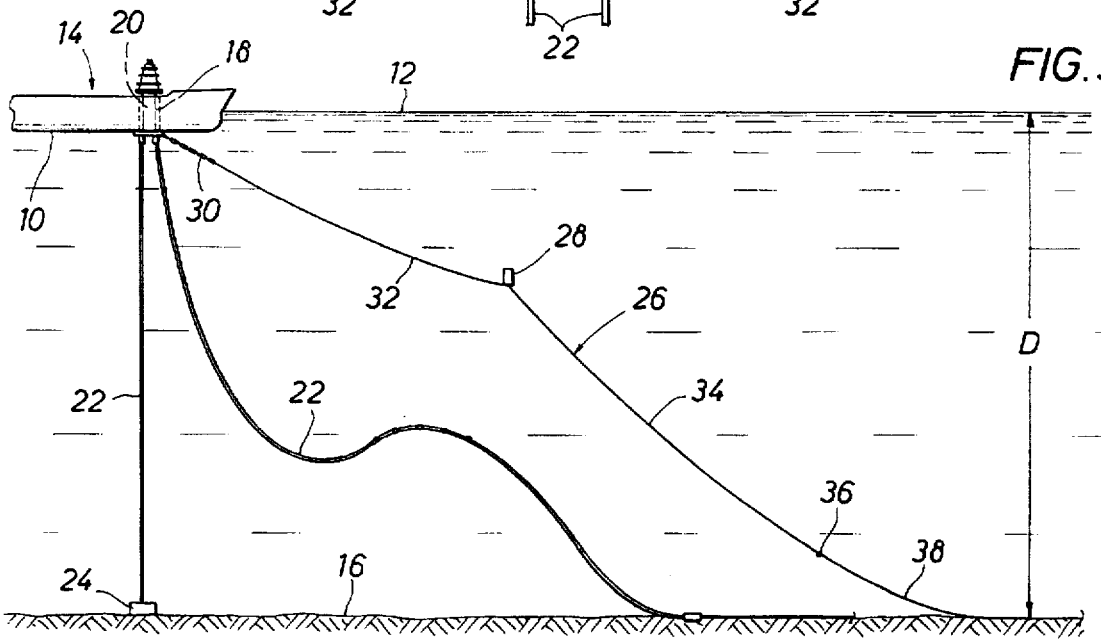
FIG. 3 is an enlarged fragment of FIG. 2 showing further features of the anchor leg and turret to which the anchor leg is connected.

As shown in FIG. 4, turret 20 is mounted for rotation on an upper bearing assembly generally indicated at 46 and a lower bearing assembly indicated at 48. Bearing assemblies 46 and 48 may be of a suitable design such as illustrated in co-pending application Ser. No. 07/767,026, dated Sep. 27, 1991 entitled "Disconnectable Turret Mooring System" now U.S. Pat. No. 5,316,509, the entire disclosure of which is incorporated by this reference. Chain 30 is received within a sleeve 50 secured to a bracket 52 on turret 20. Chain 30 then extends through pipe 50 and is anchored at its upper end to anchor support 54 on turret 20. Riser guide tubes 60 mounted within turret 20 are connected to risers 22 and extend upwardly through turret 20 for connection to suitable conducts for storage of hydrocarbons within storage vessel 10, or for possible transport to another adjacent vessel, as well known.

Support buoys 28 aid in providing a restoring force upon movement of vessel 10 because a large portion of the axial forces for each anchor leg 26 is directed into a horizontal component which provides a relatively large torque force exerted through chain 30 to assist in rotation of turret 20. As a result of these relatively large torque forces exerted by anchor legs 26 against turret 20, a separate turret drive mechanism is not required.

While a preferred embodiment of the present invention has been illustrated in detail, it is apparent that modifications and adaptations of a preferred embodiment will occur to those skilled in the art. However, it is to be expressly understood that such modifications and adaptations are within the spirit and scope of the present invention as set forth in the following claims.

What is claimed is:

1. A method for permanently mooring a floating storage vessel having a turret in the sea with anchor legs for remaining on station at all times without any quick disconnection of the turret from the anchor legs and any quick reconnection of the turret to the anchor legs for temporary removal of the vessel and with the vessel capable of maintaining a heading toward environmental forces; said method comprising the steps of:

mounting said turret (20) in a well at a position forward of a vertical center line of said vessel (10) on a bearing assembly (46) so that relative rotation of said turret and said vessel tends to occur when a longitudinal center line of said vessel is not aligned with environmental forces of the sea;

mooring said vessel to said sea bed solely with said anchor legs by disposing a plurality of anchor legs (26) between the sea bed (16) and said turret with each of said anchor legs being fixedly secured to said turret without any quick disconnection of said legs from said turret or any quick reconnection of the legs to said turret to permit temporary removal of the vessel;

extending a plurality of flexible risers (22) supported from the turret downwardly from said turret to the sea bed to receive oil or gas from production units on the sea bed;

fixedly securing a support buoy (28) to each of said anchor legs (26) at a position in each anchor leg between the sea bed (16) and said turret;

providing each anchor leg with a long length anchor leg line between said turret (20) and said buoy (28) having a length and direction forming a catenary sufficient to space said anchor leg line from said risers at all times and sufficient to direct a large portion of the axial forces along each anchor leg into a horizontal component to provide a large torque force to assist in rotation of said turret (20); and providing said buoy with a buoyancy sufficient to submerge said buoy at a depth between around 35 and 150 meters while connected to said anchor leg line, the buoyancy being commensurate with a size of said vessel and said turret to provide enhanced horizontal components of forces on said turret along those portions of said anchor leg lines between said turret and said buoy, such that when said environmental forces tend to cause said vessel to weathervane about said turret, said horizontal components of force on said turret through said anchor leg lines are sufficiently high such that torque on said turret causes said vessel to weathervane about said turret on said bearing assembly to maintain a heading of said vessel into said prevailing environmental forces without the need for powered devices on said vessel to maintain said heading.

2. The method as set forth in claim 1 including the step of:

arranging said plurality of anchor legs in an angularly spaced pattern outwardly from said turret over said risers.

3. The method as set forth in claim 1 including the step of:

forming said anchor leg line of a short length chain connected to the turret and a wire rope between said chain and said submerged support buoy to form the catenary between the turret and the submerged support buoy.

4. The method as set forth in claim 3 including the step of:

forming a second anchor leg line of a second wire rope extending from said submerged support buoy to a location above the sea bed, and a chain from the sea bed connected at its upper end to the lower end of said second wire rope above said sea bed and connected at its lower end to an anchor embedded in the sea bed.

5. A permanently moored floating storage vessel for remaining on station at all times including a turret mounted in a well at a position forward of a vertical center line of said vessel on a bearing assembly so that rotation of said turret tends to occur where a longitudinal center line of said vessel is not aligned with environmental forces of the sea, said vessel being moored solely by a plurality of anchor legs each fixedly secured to the turret at one end without any quick disconnection or reconnection thereto to permit temporary removal of the vessel and connected to the sea bed at the other end, and flexible risers supported directly by said turret extending downwardly from the turret to the sea bed for receiving hydrocarbons from production units, wherein said vessel includes an improvement comprising:

a submerged buoy of at least around 20 metric tons in displacement fixedly secured in each anchor leg, said buoy being submerged at a depth below sea level between 35 and 140 meters to form a catenary with said anchor leg between said turret and said buoy of a length sufficient to space each anchor leg from the flexible risers at all times and sufficient to direct a large portion of the axial forces for each anchor leg into a horizontal component to provide a large torque force to assist in rotation of said turret (20), the horizontal component of the weight of each anchor leg between said buoy and said anchor leg being greater than the vertical component of such anchor leg, each anchor leg having a long length anchor leg line extending between said turret (20) and said buoy (28) and fixedly connected to said turret without any quick disconnection from said turret and any quick reconnection to said turret for temporary removal of the vessel, said buoy being designed and arranged to have a buoyancy commensurate with a size of said vessel and said turret to provide enhanced horizontal components of forces on said turret along those portions of said anchor leg between said turret and said buoy, such that when said environmental forces tend to cause said vessel to weathervane about said turret, said horizontal components of forces on said turret through said anchor leg are sufficient to provide torque great enough on said turret to cause said vessel to weathervane about said turret on said bearing assembly to maintain a heading of said vessel into said prevailing environmental forces without the need for powered devices on said vessel to maintain such heading.

6. A method for permanently mooring a floating storage vessel having a turret in the sea solely with anchor legs for permanently remaining on station at all times without any quick disconnection and/or any quick reconnection of the vessel from the mooring system for temporary removal of the vessel and with the vessel capable of maintaining a heading toward environmental forces; said method comprising the steps of:

mounting said turret (20) in a well at a position forward of a vertical center line of said vessel (10) on a bearing assembly (46) so that relative rotation of said turret and said vessel tends to occur when a longitudinal center line of said vessel is not aligned with environmental forces of the sea;

mooring said vessel to said sea bed solely with said anchor legs by disposing a plurality of anchor legs (26) between the sea bed (16) and said turret with each of said anchor legs being fixedly secured to said turret without any quick disconnection from said turret and/or any quick reconnection to said turret for temporary removal of the vessel from the mooring system;

fixedly securing a support buoy (28) to each of said anchor legs (26) at a position in each anchor leg between the sea bed (16) and said turret;

providing each anchor leg with a long length anchor leg line between said turret (20) and said buoy (28) having a length and direction forming a catenary sufficient to space said anchor leg line from said risers at all times and sufficient to direct a large portion of axial forces along each anchor leg into a horizontal component to provide a large torque force to assist in rotation of said turret (20); and submerging each support buoy to a depth below sea level at least around 35 meters to form a catenary between said turret and said buoy, said buoy being of sufficient depth and distance from said turret so that said buoy does not contact the vessel under maximum storm and environmental conditions, said anchor legs and environmental forces acting on said vessel exerting a sufficient torque on said turret for rotating said vessel about said turret without any powered devices, said torque being enhanced by enhanced horizontal components of line forces exerted by the catenaries between said support buoys and said turret.

7. The method as set forth in claim 6 including the steps of:

extending a plurality of risers downwardly from said turret to said sea bed to receive oil or gas from production units on said sea bed; and submerging each support buoy at a depth and distance from said turret so that said buoy does not contact said risers under maximum storm and environmental conditions.

8. The method as set forth in claim 7 including the step of:

forming said anchor leg line of a short length chain connected to said turret, and a wire rope line between said chain and said submerged buoy several times longer that said wire rope to form the catenary between said turret and said submerged buoy.

* * * * *